United States Patent [19]

Lin

[11] Patent Number: 4,830,204

[45] Date of Patent: May 16, 1989

[54] DISPOSABLE CUP WITH AN INTEGRALLY FORMED STRAW

[76] Inventor: Chuna-Sheng Lin, 5th Fl., No. 6-3, Chin Shan Road, West Dist., Taichung City, Taiwan

[21] Appl. No.: 154,571

[22] Filed: Feb. 10, 1988

[51] Int. Cl.[4] ..... A47G 19/22; A47G 21/18

[52] U.S. Cl. ..... 215/1 A; 220/90.2; 220/90.6; 229/1.5 B; 229/103.1

[58] Field of Search ..... 215/1 A, 1 C; 229/1.5 B, 103.1; 220/90.2, 90.6; 222/572

[56] References Cited

U.S. PATENT DOCUMENTS

| | | | |
|---|---|---|---|
| 2,581,516 | 1/1952 | Cohen | 229/103.1 |
| 2,689,076 | 9/1954 | Jenkins | 229/103.1 |
| 3,332,567 | 7/1967 | Pugh, Sr. | 229/103.1 X |
| 3,774,804 | 11/1973 | Henning | 229/103.1 X |
| 4,033,453 | 7/1977 | Giaimo | 215/1 A X |
| 4,043,478 | 8/1977 | Duncan | 215/1 A X |
| 4,095,710 | 6/1978 | Tomiati | 215/1 A X |
| 4,247,016 | 1/1981 | Shaw | 229/103.1 X |
| 4,573,631 | 3/1986 | Reeves | 229/103.1 X |

FOREIGN PATENT DOCUMENTS

| | | | |
|---|---|---|---|
| 2312220 | 12/1976 | France | 215/1 A |
| 598612 | 2/1948 | United Kingdom | 229/103.1 |

*Primary Examiner*—Sue A. Weaver

*Attorney, Agent, or Firm*—Browdy and Neimark

[57] ABSTRACT

A disposable cup is equipped with an integrally formed straw on the inner wall thereof. A cut is disposed on the periphery of the mouth of the cup next to the bottom of the projecting portion of the straw. A bellow-like section is disposed at the bottom of the projecting portion so that the same can be randomly bent and arranged under part of the flanged rim along the mouth of the cup.

1 Claim, 3 Drawing Sheets

DISPOSABLE CUP WITH AN INTEGRALLY FORMED STRAW

FIELD OF THE INVENTION

The present invention relates to a disposable cup for containing beverages, especially for use in fast-food stores and characterized by an integrally formed elongate straw having a flexible projecting portion extending over the mouth of the cup. A cut is disposed on the flanged rim along the mouth of the cup and right next to the bottom end of said projectng portion, which is defined in a bellow-like form so that the same can be flexibly bended and received under the flanged rim.

BACKGROUND OF THE INVENTION

Conventionally, in fast food stores, beverages, such as juice, soft drinks are served in relatively large disposable cups, and the customers have to fetch straws themselves for sucking up the beverage from the cups. It is not hygienic and covenient in many respects; especially to some people, it will give them a little trouble to locate the straws in a large store where they visit for the first time. Moreover, the separate straws and paper cups are relatively hard to collect when serving people are cleaning the tables on which the used containers are disposed.

SUMMARY OF THE INVENTION

Therefore, the primary object of the present invention is to provide a disposable cup which is equipped with an integrally formed straw on the inner wall thereof; and on the periphery of the mouth of the cup, a cut is disposed right next to the bottom of the projecting portion of the straw, and a bellow-like section is further disposed at the bottom of said projecting portion so that the same can be randomly bended and arranged under part of the flanged rim along the mouth of the present cup.

DETAILED DESCRIPTION OF THE PREFERRED EMBODIMENT

Figure 1:
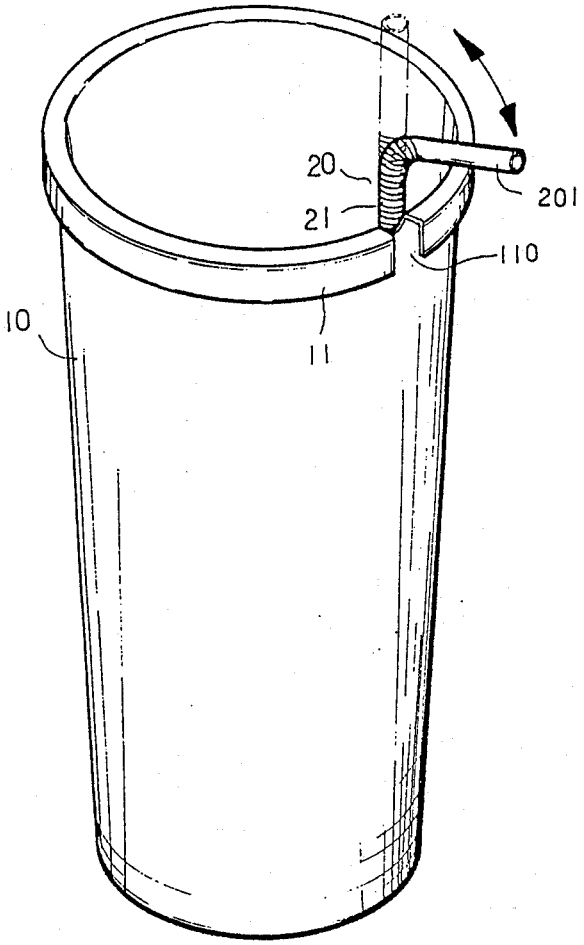
FIG. 1 is a perspective view showing the integrally formed straw having a projecting portion over the mouth of the cup body, which is provided with a bellow-like section at the bottom thereof, thus the projecting portion is flexibly arranged as shown.
Figure 2:
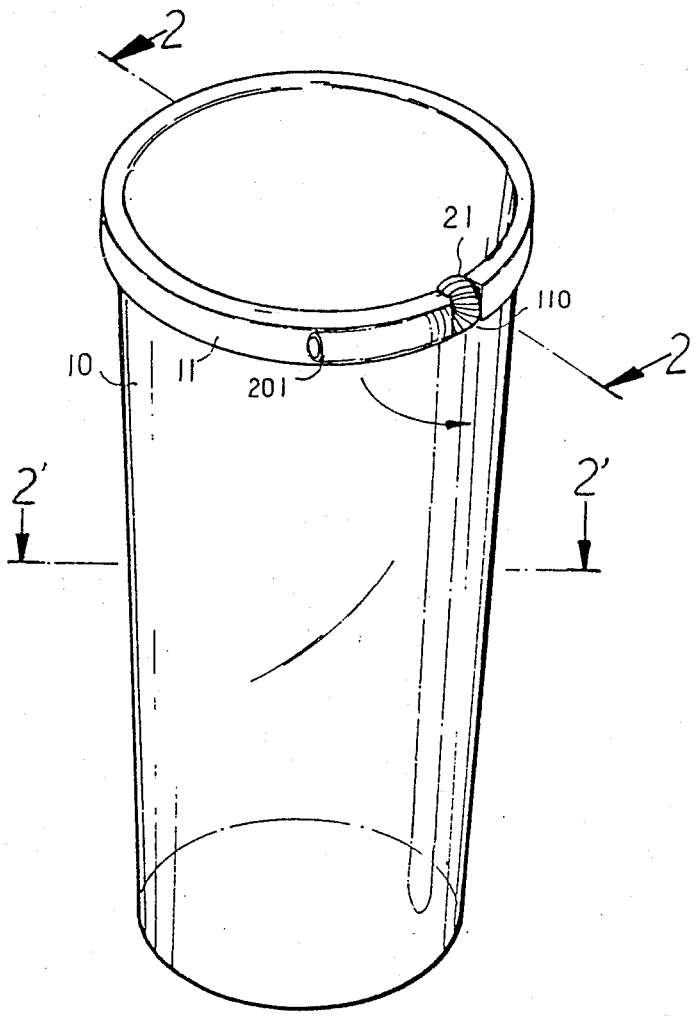
FIG. 2 is a perspective view showing the projecting portion of the straw is bended and horizontally received under the flanged rim along the mouth of the cup body.
Figure 3:
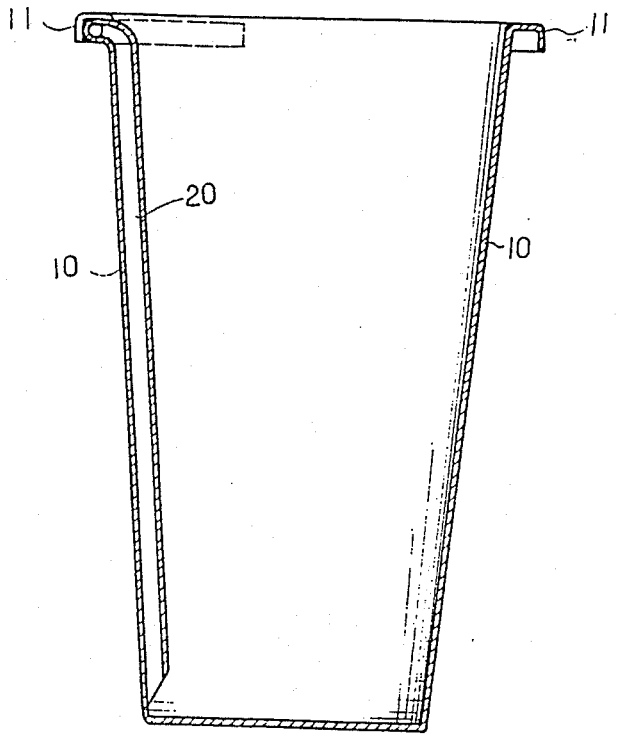
FIG. 3 is a vertical sectional view of FIG. 2, taken along the line 3—3.
Figure 4:
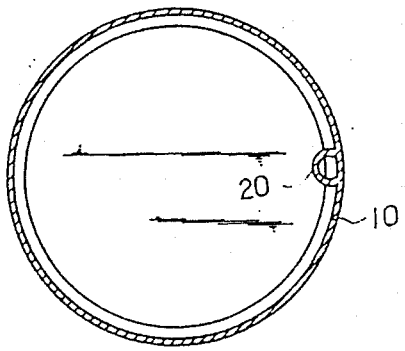
FIG. 4 is a horizontal sectional view of FIG. 2, taken along the line 4—4.

Referring to FIG. 1, the improved cup of the present invention has a plastic molded cup body 10 with an integrally formed hollow straw 20 which is disposed on the inner wall of said cup body 10 as shown in FIG. 2, FIG. 3 and FIG. 4. On the flanged rim 11 along the mouth of said cup body 10 is disposed an cut 110 which is located right at the place where the straw 20 extends over the mouth of said cup body 10, and the projecting portion 201 of said straw 20 is provided with a flexible bellow-like portion 21 which is bendable in any direction so that the projecting portion 201 can be received under part of the flanged rim 11, as shown in FIG. 2.

Thus, the straw 20 is readily available as long as the extended portion 201 is pulled out from its receiving position and extended straight or in any other way for use. Such arrangement enables people to make use of the straws in a more hygienic and convenient way.

While the present invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims.

What I claim is:

1. An improved disposable cup with a flanged rim and an elongate straw integrally formed and disposed on the inner wall of said cup, means forming a top end of the straw for extending over the periphery of the mouth of the cup, defining a projecting portion thereof; and a cut being defined on the flanged rim along the periphery of the mouth of said cup and at the position right next to the bottom end of said projecting portion, and the lower section of said projecting portion is structured in a bellow-like form so that the projecting portion can be flexibly bent downwardly through said cut and further received under part of said flanged rim.

* * * * *